US011427421B2

(12) United States Patent
Chong et al.

(10) Patent No.: US 11,427,421 B2
(45) Date of Patent: Aug. 30, 2022

(54) STACK HEIGHT IN IMAGING DEVICES

(71) Applicant: Hewlett-Packard Development Company, L.P., Spring, TX (US)

(72) Inventors: Kok Chai Chong, Singapore (SG); Tong Nam Samuel Low, Singapore (SG); Ban Ho Chong, Singapore (SG); Jun Hong Goh, Singapore (SG); Seng San Koh, Singapore (SG)

(73) Assignee: Hewlett-Packard Development Company, L.P., Spring, TX (US)

( * ) Notice: Subject to any disclaimer, the term of this patent is extended or adjusted under 35 U.S.C. 154(b) by 34 days.

(21) Appl. No.: 17/046,134

(22) PCT Filed: Apr. 20, 2018

(86) PCT No.: PCT/US2018/028510
§ 371 (c)(1),
(2) Date: Oct. 8, 2020

(87) PCT Pub. No.: WO2019/203841
PCT Pub. Date: Oct. 24, 2019

(65) Prior Publication Data

US 2021/0039899 A1 Feb. 11, 2021

(51) Int. Cl.
*B65H 7/14* (2006.01)
*B65H 1/14* (2006.01)
(Continued)

(52) U.S. Cl.
CPC ..... *B65H 7/14* (2013.01); *B65H 1/12* (2013.01); *B65H 1/14* (2013.01); *B65H 3/0653* (2013.01); *B65H 3/0661* (2013.01); *B65H 7/04* (2013.01); *B65H 2511/152* (2013.01); *B65H 2553/41* (2013.01)

(58) Field of Classification Search
CPC ... B65H 1/04; B65H 1/08; B65H 1/12; B65H 1/18; B65H 3/06; B65H 3/0661; B65H 7/00; B65H 7/02; B65H 7/04; B65H 7/14; B65H 2511/152; B65H 2511/22; B65H 2553/40; B65H 2553/41
See application file for complete search history.

(56) References Cited

U.S. PATENT DOCUMENTS 6,247,695 B1 6/2001 Linder
6,308,951 B1 10/2001 Allmendinger et al.
(Continued)

*Primary Examiner* — Prasad V Gokhale
(74) *Attorney, Agent, or Firm* — Austin Rapp

(57) ABSTRACT

Examples relating to determining stack height in imaging devices are described herein. According to one example, an imaging device includes an input roller assembly to transport a print medium towards an image-forming assembly of the imaging device. The input roller assembly can include a pinch roller for drawing the print medium from a media stack. The imaging device further includes a pressure plate movably coupled to a body portion of the imaging device and biased towards the pinch roller. The pressure plate may hold the media stack between itself and the pinch roller and is movable by a first distance from a neutral position when the media stack is there between. The first distance is measured from a fixed point to a measurement region on the pressure plate and can indicate an instantaneous stack height of the media stack.

13 Claims, 4 Drawing Sheets

(51) Int. Cl.

| | |
|---|---|
| ***B65H 3/06*** | (2006.01) |
| ***B65H 7/04*** | (2006.01) |
| ***B65H 1/12*** | (2006.01) |

(56) References Cited

U.S. PATENT DOCUMENTS

| | | | | |
|---|---|---|---|---|
| 6,634,818 | B2 | 10/2003 | Sato et al. | |
| 7,374,163 | B2 | 5/2008 | Cook et al. | |
| 7,920,256 | B2 * | 4/2011 | Lee | G03G 15/6508 356/213 |
| 8,167,300 | B1 | 5/2012 | Blair et al. | |
| 8,246,041 | B2 | 8/2012 | Gagnon et al. | |
| 8,398,077 | B2 | 3/2013 | Uehara et al. | |
| 8,439,351 | B1 | 5/2013 | Burke | |
| 8,500,118 | B2 | 8/2013 | Shimmachi et al. | |
| 2002/0066992 | A1 | 6/2002 | Lim | |
| 2005/0035531 | A1 * | 2/2005 | Sasaki | B65H 3/0607 271/126 |
| 2008/0217842 | A1 * | 9/2008 | Hoffman | B65H 3/0676 271/167 |
| 2010/0322689 | A1 * | 12/2010 | Ohtani | B65H 7/04 399/388 |
| 2011/0064508 | A1 | 3/2011 | Youn | |
| 2012/0104680 | A1 | 5/2012 | Blair | |
| 2015/0187159 | A1 * | 7/2015 | Yin | G07D 11/40 271/10.09 |
| 2020/0385223 | A1 * | 12/2020 | Witkoe | B65H 1/12 |

* cited by examiner

STACK HEIGHT IN IMAGING DEVICES

BACKGROUND

Imaging devices, such as printers and scanners, may be used for transferring print data on to a medium, such as paper, by a non-impact process. The print data may include, for example, a picture or text or a combination thereof, and may be received from a computing device. The imaging device may have an image-forming assembly, such as a printhead, to form an image or text on the medium by precisely delivering small volumes of a printing substance on to the medium. For instance, the printing substance can be a printing fluid, such as ink, in case of a two-dimensional (2D) printer and can be build material in case of a three-dimensional (3D) printer. The imaging device further includes a media input tray for holding a media stack which may be drawn towards the image-forming assembly for printing.

BRIEF DESCRIPTION OF FIGURES

The detailed description is provided with reference to the accompanying figures. It should be noted that the description and the figures are merely examples of the present subject matter, and are not meant to represent the subject matter itself.

Figure 1:
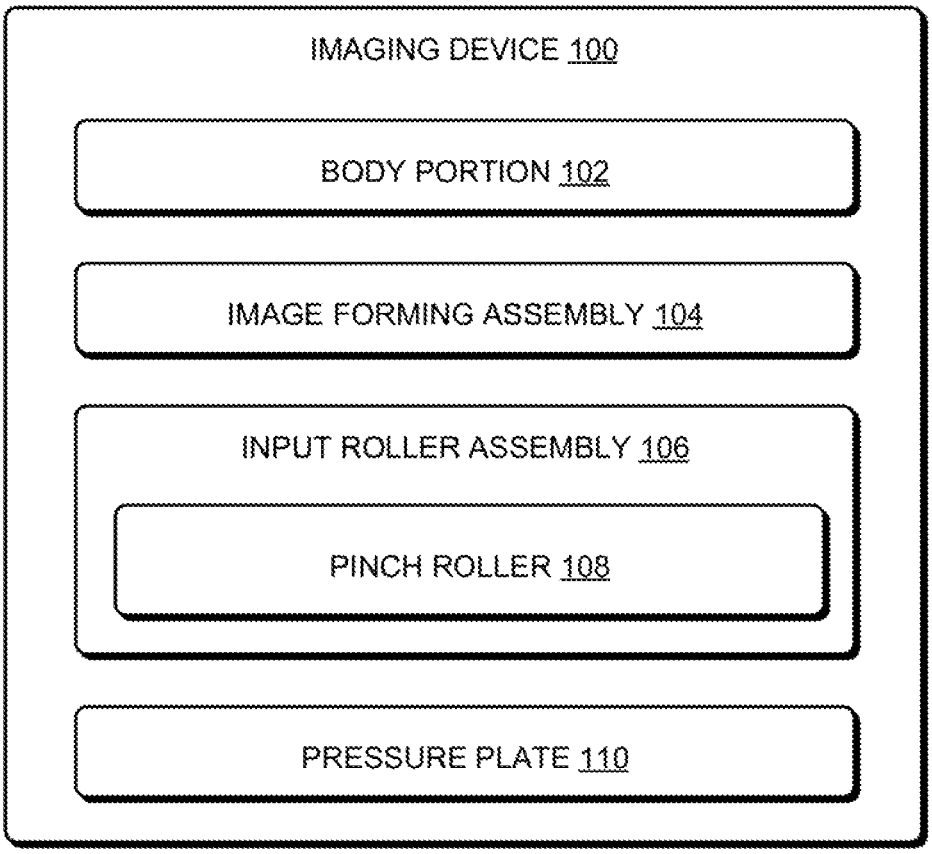
FIG. 1 illustrates a schematic of an imaging device for detecting a stack height of a media stack placed in the imaging device, according to an example.

Throughout the drawings, identical reference numbers designate similar elements, but may not designate identical elements. The figures are not necessarily to scale, and the size of some parts may be exaggerated to more dearly illustrate the example shown. Moreover, the drawings provide examples and/or implementations consistent with the description; however, the description is not limited to the examples and/or implementations provided in the drawings.

DETAILED DESCRIPTION

Generally, an imaging device is provided with a feature of detecting stack height, for example, in order to provide an alert to the user when the imaging device has less quantity of media. Certain imaging devices employ an optical distance sensor, for instance, an infrared (IR) sensor, which determines a position of a top of the stack of media to determine the stack height. In the above example, the IR sensor, using an intensity of a signal reflected from media to the IR sensor, ascertains the stack height of the media stack. However, such an approach may not accurately ascertain the stack height, such as for the following reasons. Firstly, a surface finish of the media, for instance, depending on media type, reflectance properties of the media, and pattern on the surface of the media, influences the reflection of the signal from the top of the media stack. Therefore, the IR sensor may provide different readings of the stack height for different kinds of media, even when the different stacks have the same actual height. Secondly, there may be air pockets formed between sheets of media in the stack which may also hamper the accuracy in determining the stack height.

In the alternative, some imaging devices, instead, use an optical distance sensor in combination with a mechanical flag—one end of which is in direct contact of the top of the media stack in the input tray and the other end is proximal and relatively movable with respect to the optical distance sensor for the optical distance sensor to determine the stack height. While more accurate than the optical distance sensor measuring the stack height directly by impinging signal on the top of the stack, such techniques still are unable to overcome the inaccuracies caused by the air pockets between the media sheets, as explained previously.

Certain other imaging devices may include an optical distance sensor mounted on a roller assembly of the imaging device, the roller assembly being in direct contact with the media stack. The optical distance sensor is constructed to have two parts which are relatively movable with respect to each other depending on the motion of the roller assembly with respect to the media stack which, in turn, is dependent on the height of the media stack. Therefore, the relative movement of the components of the optical distance sensor may provide a measure of the stack height of the media stack. However, such techniques also fail to address inaccuracies in measurement due to the air pockets being formed between the media sheets in the media stack, and therefore, the measurement performed by the technique disclosed in the present reference would also be considerably inaccurate. In addition, such imaging systems have many moving parts, thereby making such systems prone to a high degree of wear and tear. In addition, the manufacturing of such an imaging system may be labor-intensive, skill-intensive, and time-intensive making the manufacturing costly.

Yet other approaches for determining a stack height of print media in an imaging device are described. According to an aspect, the imaging device includes an input roller assembly to transport a medium from a media input tray towards an image-forming assembly, such as a printhead or a scanhead. The input roller assembly includes a pinch roller for drawing or pulling the medium from a media stack, which is positioned under the pinch roller. In addition, the imaging device includes a pressure plate for holding the media stack under the pinch roller. In an example, the pressure plate may form a portion of a media input tray of the imaging device. In another case, however, the pressure plate may act as the media input tray itself. In other words, in the latter case, the media input tray can be formed as a pressure plate.

According to an aspect, the pinch roller and the pressure plate cooperate to achieve two functions—the media stack is compressed between the pinch roller and the pressure plate so that there are no air pockets formed between media sheets, and the distance between the pressure plate and the pinch roller is measured to determine an instantaneous stack height of the media stack, interchangeably referred to as the stack height henceforth. Therefore, as used herein, the term "instantaneous stack height" refers to a height of the stack at a given instant when the detection of the stack height is being done, and is indicative of a number of print media sheets remaining in the media stack at that given instant and/or a thickness of the number of print media sheets remaining in the media stack at that given instant.

In an example, the pressure plate may be movably coupled to a body portion of the imaging device and biased towards the pinch roller. As such, the pressure plate may be preloaded to apply a force towards the pinch roller. As mentioned above, the pressure plate holds the media stack against the pinch roller and the bias towards the pinch roller prevents the formation of air pockets in the media stack. In addition, when the media stack is positioned on the pressure plate between the pressure plate and the pinch roller, depending on the height of the media stack, the pressure plate moves by a predetermined distance. For example, the pressure plate may be in a first position proximal to the pinch roller, when unloaded, (e.g., when there is no media stack on the pressure plate). And the pressure plate may be in a second position distal to the pinch roller, when completely loaded with the media stack. As such, the first position may be such that the pressure plate is closer to the pinch roller than while in the second position. And in the second position, the pressure plate is further from the pinch roller than while in the first position. The pressure plate may have multiple intermediate positions between the first and the second position when the media stack corresponds to less than a full capacity for the media input tray. Consequently, intermediate positions of the pressure plate may depend on the stack height of the media stack that regulates the distance between the pressure plate and the pinch roller, e.g., the distance by which the pressure plate moves.

The distance moved by the pressure plate from a neutral position, referred to as a first distance, is measured from a fixed point on the body portion of the imaging device to a measurement region on the pressure plate. For example, the neutral position can be the position in which the pressure plate is not loaded with the print media. At the fixed point on the body portion of the imaging device, a non-contact measuring device may be mounted, which may transmit a signal towards a flat surface of the pressure plate. The non-contact measuring device, such as an optical distance sensor, may then obtain the reflected signal from the flat surface. The non-contact measuring device can then determine the instantaneous distance that the pressure plate is at from the non-contact measuring device, e.g., the instantaneous intermediate position of the pressure plate with respect to the pinch roller, which may indicate the stack height. In another example, the instantaneous intermediate position of the pressure plate may be determined in terms of an angular movement or angular position of the pressure plate. In said example, the angular distance by which the pressure plate moves when the media stack is positioned between the pressure plate and the pinch roller is referred to as the first angular movement.

The pressure plate may include a first surface which faces the pinch roller and holds the media stack and a second surface which is away from the pinch roller. In an example, the measurement region on the pressure plate may be the second surface of the pressure plate which is used to measure the first distance moved by the pressure plate from the neutral position towards the fixed point, for instance, the non-contact measuring device, depending on the stack height of the media stack.

Since the measurement of the stack height is done using a signal reflected from a predefined measurement region, such as a flat surface of the pressure plate there may be lower variation in measurement, such as due to media reflectance or air pockets between media sheets. Accordingly, the approaches of determining stack height of the media stack, according to the present subject matter, may have good repeatability. In addition, since the formation of air pockets in the media stack is substantially prevented, it may be that the stack height of the media stack can be determined with comparative accuracy.

The above aspects are further illustrated in the figures and described in the corresponding description below. It should be noted that the description and figures merely illustrate principles of the present subject matter. Therefore, various arrangements that encompass the principles of the present subject matter, although not explicitly described or shown herein, may be devised from the description and are included within its scope. Additionally, the word "coupled" is used throughout for clarity of the description and may include either a direct connection or an indirect connection.

FIG. 1 illustrates a schematic of an imaging device 100 for detecting a stack height of a media stack therein, according to an example of the present subject matter. Examples of the imaging device 100 may include, but are not limited to, printers, scanners, copiers, fax machines, and the like. Accordingly, the imaging device 100 can recreate digital content, such as text, images, and pictures, on a print media in the media stack by transferring print substance onto the print media. The imaging device 100 may detect an instantaneous stack height of the media stack with considerable accuracy, as will be described in the forthcoming sections.

The imaging device 100 may be part of the network environment to cooperate and obtain imaging requests along with the digital content for the imaging requests. As part of the operation, the imaging device 100 can monitor the stack height of the media stack to indicate to a user regarding the print media remaining in the media stack.

The imaging device 100 can include a body portion 102, such as a housing, that can house various components of the imaging device 100. The imaging device 100 can also include an image forming assembly 104 and an input roller assembly 106 to transport the print medium towards the image-forming assembly. In an example, the image forming assembly 104 can be a printhead in case the imaging device 100 is a printer, such as a two-dimensional (2D) printer or a three-dimensional (3D) printer, or a copier. The input roller assembly 106 can include a pinch roller 108 for drawing the print medium from a media stack in the imaging device 100. For instance, the pinch roller 108 can be formed of rubber or other flexible material which can create a pinch force on the print medium to draw the print medium from the medium stack one-by-one, Further, the imaging device 100 can include a pressure plate 110 movably coupled to the body portion 102 and that is biased towards the pinch roller 108. In other words, the pressure plate 110 can be biased in a way that in a neutral or unloaded position, the pressure plate 110 can be positioned towards the pinch roller 108, for instance, abutting the pinch roller 108. In the loaded position of the imaging device, the media stack can be positioned between the pressure plate 110 and the pinch roller 108 to hold the media stack therebetween.

As mentioned above, the pressure plate 110 is movably mounted on the body portion 102. According to an aspect, when the media stack is positioned between the pressure plate 110 and the pinch roller 108, the pressure plate 110 is relatively movable by a first distance, for instance, from the neutral position in which there is no print media on the pressure plate 110. The first distance, so moved by the pressure plate 110, is directly indicative of the instantaneous stack height of the media stack. In other words, the first distance by which the pressure plate 110 moves when the media stack is between the pressure plate 110 and the pinch roller 108 is almost equal to the instantaneous stack height of the media stack. The first distance is measured from a measurement region on the pressure plate 110 to a fixed point on the body portion 102 of the imaging device 100.

Figure 2:
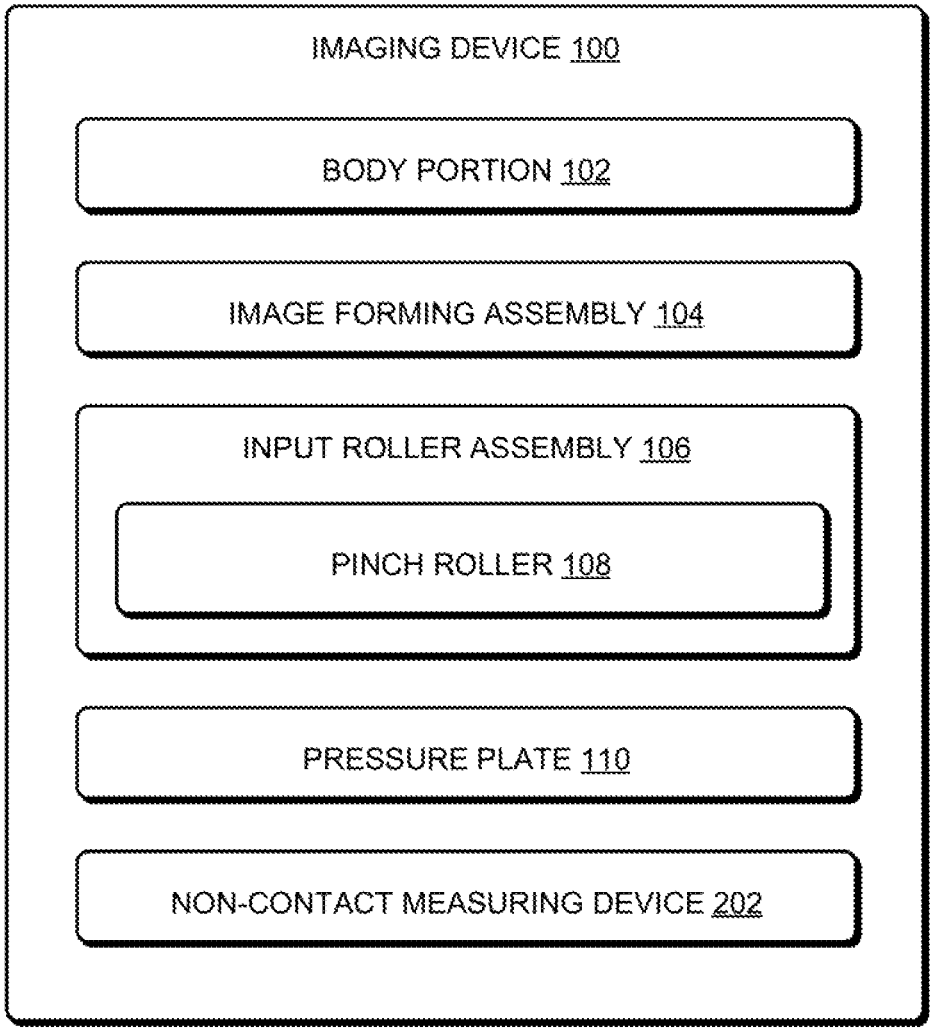
FIG. 2 illustrates another schematic of the imaging device for detecting the stack height of the media stack placed therein, according to another example.

FIG. 2 illustrates another schematic of the imaging device 100 for detecting stack height of the media stack, according to another example of the present subject matter. In said example, in addition to the previous example, the pressure plate 110, depending on the stack height of the media stack positioned thereon between the pressure plate 110 and the pinch roller 108, may have a first position, a second position, and an intermediate position. In the first position, the pressure plate 110 can be proximal to the pinch roller 108 when unloaded. In other words, in the first position, the pressure plate 110 is closest to the pinch roller 108, or in a neutral position. In the second position, the pressure plate 110 is distal to the pinch roller 108 when completely loaded with the media stack. This means that the pressure plate is at the farthest position in the second position, when it is loaded at maximum capacity with the media stack. The pressure plate 110 is in the intermediate position between the first and the second position, when less than completely loaded with print media. In other words, the intermediate position of the pressure plate 110 corresponds to less than a full capacity for the media input tray (not shown in FIG. 2). In the intermediate position, the pressure plate 110 may assume any position between the first position and the second position.

Further, in said example, the imaging device 100 can include a non-contact measuring device 202 fixedly mounted on the body portion 102 to monitor a relative position of a measurement region on the pressure plate 110. For example, the non-contact measuring device 202 can be an optical distance sensor or a proximity sensor. The relative position of the measurement region can be monitored from the non-contact measuring device 202 or from the pinch roller 108 or both, and it can be indicative of the relative position of the pressure plate as being in the first position, the second position, or the intermediate position. As explained previously, the first position, the second position, and the intermediate position are dependent on the instantaneous stack height of the media stack between the pressure plate 110 and the pinch roller 108.

Figure 3:
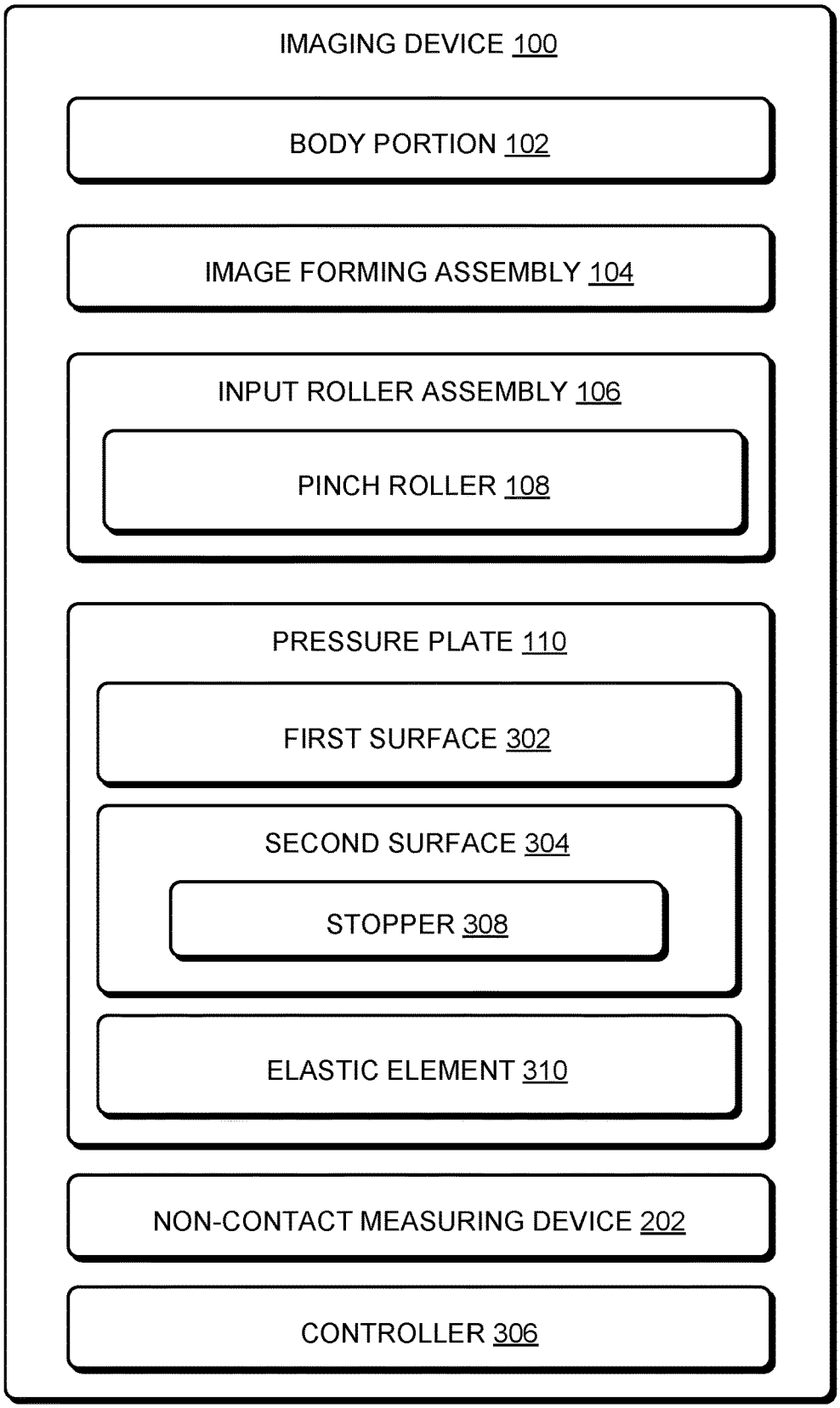
FIG. 3 illustrates yet another schematic of the imaging device for detecting the stack height of the media stack placed therein, according to yet another example.

FIG. 3 illustrates one other schematic of the imaging device 100 for detecting stack height of the media stack, according to yet another example of the present subject matter. In said example, in addition to the previously mentioned examples, the pressure plate 110 has a first surface 302 facing the pinch roller 108 and a second surface 304 away from the pinch roller 108. As mentioned previously, the media stack is positionable between pressure plate 110 and the pinch roller 108, in said example, between the first surface 302 and the pinch roller 108. When the media stack is positioned between the first surface 302 and the pinch roller 108, the pressure plate 110 may exhibit a first angular movement away from the pinch roller 108 from the unloaded condition. In other words, the pressure plate 110 may exhibit a first angular movement substantially equal to the stack height of the media stack, away from the pinch roller 108.

As in the previous example, the angular movement of the pressure plate 110 can be measured from a fixed position on the body portion 102. Accordingly, in said example, the imaging device 100 may further include a non-contact measuring device 202 fixed on the body portion 102 to monitor the relative position of the pressure plate 110. The non-contact measuring device 202 can monitor a relative position of the second surface 304 of the pressure plate 110 to measure the first angular movement of the pressure plate 110, the position being relative to the neutral position, for instance, in which the pressure plate is not loaded with the print media. In addition, the imaging device 100 can further include a controller 306 which can determine the stack height of the media stack based on the first angular movement of the pressure plate 110. As mentioned previously, the first angular movement of the pressure plate 110 is due to the media stack being present between the pressure plate 110 and the pinch roller 108. Therefore, an instantaneous angular position of the pressure plate 110, e.g., the angular position of the pressure plate 110 at a given instant, is indicative of the stack height of the media stack at that given instant.

Figure 4:
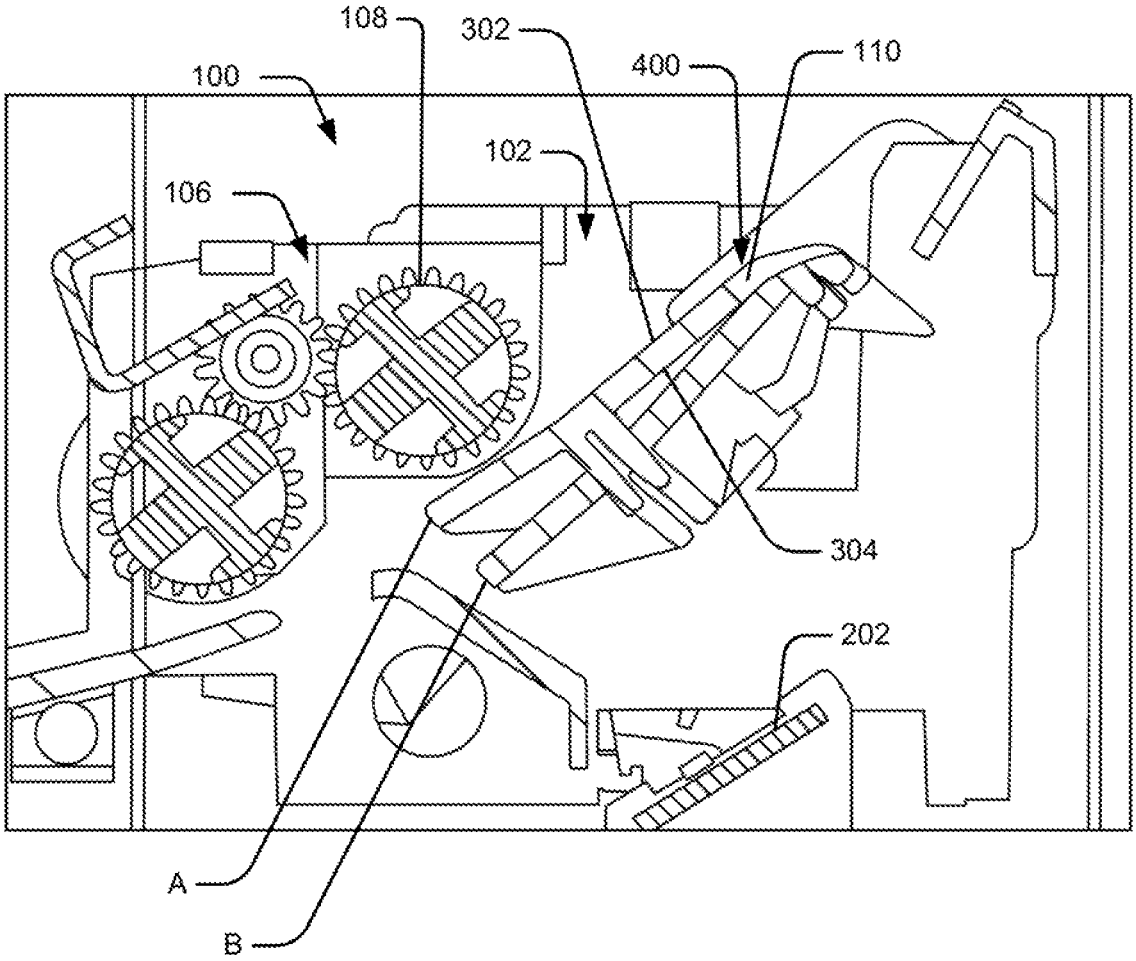
FIG. 4 illustrates a cross-sectional view of the imaging device for detecting the stack height of the media stack placed therein, according to an example.

FIG. 4 illustrates a sectional view of the imaging device 100 showing components of the imaging device 100, according to an example of the present subject matter. As mentioned previously, the imaging device 100 may include the body portion 102 which supports and houses various components of the imaging device 100, such as an image forming assembly (e.g. the image forming assembly 104 as shown in FIGS. 1, 2, and 3), the input roller assembly 106, and a media input tray 400. The image forming assembly 104 may, in one example in which the imaging device 100 is a printer, be a printhead. In another example in which the imaging device 100 is a scanner, the image forming assembly 104 may be a scanhead. Other similar examples of the image forming assembly 104 are also envisaged in accordance with aspects of the imaging device 100.

Further, in an example, the media input tray 400 of the imaging device 100 may position and hold the media stack for being fed to the image forming assembly 104. In an example, the pressure plate 110 can be a part of the media input tray 400, e.g., the media input tray 400 may be a flat component and the pressure plate 110 may be a movable segment of the flat component. In another example, the pressure plate 110 can function as the media input tray 400 or vice-versa, e.g., the entire flat component is movable to act as the pressure plate 110. As mentioned previously, the pressure plate 110 can be movably mounted to the body portion 102.

For example, the pressure plate 110 can be pivotably mounted at the body portion 102. Accordingly, a first longitudinal end of the pressure plate 110 can be pivoted at the body portion, whereas the second longitudinal end can be free to move, allowing the pressure plate 110 to execute angular movement. In other cases, other types of mounting of the pressure plate 110 can be achieved allowing the pressure plate 110 to be movable with respect to the pinch roller 108.

In an example, the pinch roller 108 can be rotatably mounted at a fixed location on the body portion 102. In another example, the pinch roller 108 can be preloaded, say using an elastic element 310, to be biased towards the pressure plate 110. The relative bias of the pressure plate 110 and the pinch roller 108 towards each other can create a compression force on the media stack due to which any air pockets formed between the sheets in the media stack can be removed. In an example, a reaction force due to the pinch roller 108 and a reaction force due to the pressure plate 110 can be aligned in order to effectively compress the media stack between them.

Further, as also previously mentioned, the pressure plate 110 may be biased towards the pinch roller 108 and may have the first surface 302 and the second surface 304, the first surface 302 being towards the pinch roller 108 and the second surface 304 being away. For instance, in the neutral position A in which the pressure plate 110 has no print media, shown in FIG. 4, the first surface of the pressure plate 110 may be abutted against the pinch roller 108. In an example, the pressure plate 110 can be preloaded with an elastic element 310, such as a spring, to bias the pressure plate towards the pinch roller 108.

The pressure plate 110 can be movable, for instance, about the pivot point, with respect to the pinch roller 108, based on the stack height of the media stack. In other words, the pressure plate 110 can be relatively movable with respect to a fixed point on the body portion 102 based on the thickness of the media stack between the pressure plate 110 and the pinch roller 108. As the sheets of print media are drawn by the pinch roller 108 towards the image forming assembly 104, the stack height of the media stack may gradually decrease, causing the pressure plate 110 to move relative to the fixed point on the body portion 102. In a completely loaded position B, the first surface 302 can be at farthest position from the pinch roller 108. For example, the second surface 304 can have a stopper 308 to limit the movement of the pressure plate 110 beyond the completely loaded position B.

To determine an extent of movement or an instantaneous position of the pressure plate 110 or both, the non-contact measuring device 202 can be positioned at a fixed point on the body portion 102. In an example, the non-contact measuring device 202 can be an optical distance sensor or a proximity sensor. The non-contact measuring device 202 can monitor a measurement region on the pressure plate 110 to determine the instantaneous position of the pressure plate 110. For instance, the non-contact measuring device 202 can monitor the position of the second surface 304 of the pressure plate 110 with respect to itself, e.g., the non-contact measuring device 202. The non-contact measuring device 202 can impinge a signal, such as an infrared (IR) signal, on the measurement region, for instance, a flat surface of the pressure plate 110. The reflected signal from the second surface 304 can be used to assess the instantaneous position of the pressure plate 110. In an example, the non-contact measuring device 202 can impinge the signal at second surface 304 which can act as the measurement region.

Further, the non-contact measuring device 202 can be operably coupled to a controller (e.g., controller 306 of FIG. 3) to cooperate with the controller 306 in detecting the instantaneous stack height of the media stack. In an example, the functionalities of the controller 306 can be implemented by way of engines (not shown). The engines are employed as a combination of hardware and programming (for example, programmable instructions) to use functionalities of the engines. In examples described herein, such combinations of hardware and programming may be used in a number of different ways. For example, the programming for the engines may be processor executable instructions stored on a non-transitory machine-readable storage medium and the hardware for the engines may include a processing resource (for example, processors), to execute such instructions. In the present examples, the machine-readable storage medium stores instructions that, when executed by the processing resource, deploy engines. In such examples, the imaging device 100 may include the machine-readable storage medium storing the instructions and the processing resource to execute the instructions, or the machine-readable storage medium may be separate but accessible to imaging device 100 and the processing resource. In other examples, engines may be deployed using electronic circuitry. The controller 306, among other things and in addition to the engines, may include a memory (not shown) having data. The engines, among other capabilities, may fetch and execute computer-readable instructions stored in the memory. The memory, communicatively coupled to the engines, may include a non-transitory computer-readable medium including, for example, volatile memory, such as Static Random-Access Memory (SRAM) and Dynamic Random-Access Memory (DRAM), and/or non-volatile memory, such as Read-Only Memory (ROM), erasable programmable ROM, flash memories, hard disks, optical disks, and magnetic tapes.

In operation, as mentioned above, the pressure plate 110 holds the media stack therebetween and the pinch roller 108. When the media stack is positioned on the pressure plate 110 between the pressure plate 110 and the pinch roller 108, depending on the instantaneous stack height of the media stack, the pressure plate 110 is at a distance from the pinch roller 108. In other words, the instantaneous position of the pressure plate 110 with respect to the pinch roller 108 or the non-contact measuring device 202 is dependent on the instantaneous stack height of the media stack. The non-contact measuring device 202 can monitor the instantaneous position of the pressure plate 110 and provide the instantaneous position to the controller 306. Based on the instantaneous position of the pressure plate 110, the controller 306 can assess the stack height of the media stack, e.g., the approximate number of sheets of print media remaining in the media stack. The controller 306 may further generate an alert or an indication for a user when the stack height is below a predefined threshold level. In other words, the controller 306 can indicate a condition of low media to the user, and the user can refill the media stack with more print media.

In an example, the controller 306, using the input from the non-contact measuring device 202, determine that the pressure plate may be in a first position proximal to the pinch roller. This position is shown as the unloaded position A corresponding to a position in which there is no media stack on the pressure plate. When the pressure plate is completely loaded with the media stack, the controller 306 may determine the pressure plate 110 to be in the second position distal to the pinch roller, and indicated by the completely loaded position B. In addition, the controller 306 may determine the pressure plate 110 to be in one of many intermediate positions between the first position A and the second position B, when the pressure plate is loaded with the media stack but less than full capacity. Since the intermediate position of the pressure plate 110 depends on the stack height of the media stack that regulates the distance between the pressure plate and the pinch roller, e.g., the distance by which the pressure plate moves away from the pinch roller 108 and towards the non-contact measuring device 202, based on the instantaneous position of the pressure plate 110, the controller 306 can detect the stack height of the media stack in the imaging device 100.

In another example, the controller 306 may determine the instantaneous intermediate position of the pressure plate 110 in terms of an angular movement or instantaneous angular position of the pressure plate 110. In the present example, the angular movement by which the pressure plate 110 moves when the media stack is positioned between the pressure plate 110 and the pinch roller is referred to as the first angular movement. The non-contact measuring device 202 can, in the present example, determine a relative angular movement exhibited by the pressure plate 110 with respect to either the pinch roller 108, the non-contact measuring device 202, or any other reference points, to assess the instantaneous angular position of the pressure plate 110. Based on the instantaneous angular position of the pressure plate 110, the controller 306 can determine the stack height of the media stack in the imaging device 100.

Although examples for detecting stack height of a media stack in imaging devices have been described in language specific to structural features and/or methods, it is to be understood that the appended claims are not limited to the specific features or methods described. Rather, the specific features and methods are disclosed as examples for detecting stack height of a media stack in imaging devices.

We claim:

1. An imaging device comprising:

a body portion;

an input roller assembly to transport a print medium towards an image-forming assembly, the input roller assembly comprising a pinch roller to draw the print medium from a media stack; and a pressure plate movably coupled to the body portion of the imaging device and biased towards the pinch roller, the pressure plate and the pinch roller to hold the media stack therebetween, wherein the pressure plate is movable by a first distance from a neutral position when the media stack is between the pressure plate and the pinch roller, the first distance to be measured from a fixed point on the body portion of the imaging device to a measurement region on the pressure plate and to be indicative of an instantaneous stack height of the media stack, and wherein the pressure plate comprises:

a first surface facing the pinch roller and that is to hold the media stack; and a second surface facing away from the pinch roller, wherein the measurement region is on the second surface.

2. The imaging device as claimed in claim 1, further comprising a non-contact measuring device fixed on the body portion to monitor the first distance moved by the pressure plate by impinging a signal at the measurement region on the pressure plate.

3. The imaging device as claimed in claim 2, further comprising a controller to determine the instantaneous stack height of the media stack based on monitoring by the non-contact measuring device to indicate low media.

4. The imaging device as claimed in claim 1, wherein the pressure plate is biased towards the pinch roller using an elastic element.

5. The imaging device as claimed in claim 1, wherein the pressure plate is pivotably mounted at the body portion of the imaging device.

6. An imaging device comprising:

a body portion;

an input roller assembly to transport a print medium towards an image-forming assembly, the input roller assembly comprising a pinch roller to draw the print medium from a media stack;

a pressure plate movably coupled to the body portion of the imaging device and biased towards the pinch roller, the pressure plate comprising a first surface facing the pinch roller, and a second surface away from the pinch roller, the media stack to be positionable between the first surface and the pinch roller, wherein the pressure plate is to exhibit a first angular movement from a neutral position when the media stack is between the pressure plate and the pinch roller, and wherein the pressure plate comprises:

a first surface facing the pinch roller and that is to hold the media stack; and a second surface facing away from the pinch roller, wherein the measurement region is on the second surface;

a non-contact measuring device fixed on the body portion to monitor a relative position of the second surface to measure the first angular movement of the pressure plate; and a controller to determine an instantaneous stack height of the media stack based on the first angular movement of the pressure plate.

7. The imaging device as claimed in claim 6, wherein the pressure plate is biased towards the pinch roller using an elastic element.

8. The imaging device as claimed in claim 6, wherein the pressure plate is pivotably mounted at the body portion of the imaging device.

9. An imaging device comprising:

an input roller assembly to transport a print medium towards an image-forming assembly, the input roller assembly comprising a pinch roller to draw the print medium from a media stack; and an media input tray comprising a pressure plate movably coupled to a body portion of the imaging device and biased towards the pinch roller, wherein the pressure plate is to be in a first position proximal to the pinch roller when unloaded, to be in a second position distal to the pinch roller when completely loaded with the media stack, and to be in an intermediate position between the first and the second position when the media stack corresponds to less than a full capacity for the media input tray, the pressure plate being loaded with the media stack positionable between the pressure plate and the pinch roller, and wherein the pressure plate comprises:

a first surface facing the pinch roller and that is to hold the media stack; and a second surface facing away from the pinch roller, wherein the measurement region is on the second surface; and a non-contact measuring device fixedly mounted on the body portion to monitor a position of a measurement region of the pressure plate to determine the pressure plate to be in one of the first position, the second position, and the intermediate position, wherein the first position, the second position, and the intermediate position are indicative of an instantaneous stack height of the media stack.

10. The imaging device as claimed in claim 9, further comprising a controller to determine the instantaneous stack height of the media stack based on monitoring by the non-contact measuring device to indicate low media.

11. The imaging device as claimed in claim 9, wherein the second surface comprises a stopper to limit a movement of the pressure plate beyond the second position.

12. The imaging device as claimed in claim 9, wherein the pressure plate is biased towards the pinch roller using an elastic element.

13. The imaging device as claimed in claim 9, wherein the pressure plate is pivotably mounted at the body portion of the imaging device.

* * * * *